US006229512B1

(12) United States Patent
Shigehiro

(10) Patent No.: US 6,229,512 B1
(45) Date of Patent: May 8, 2001

(54) FLAT PANEL DISPLAY UNIT AND DISPLAY METHOD OF THE SAME

(75) Inventor: Koji Shigehiro, Tokyo (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/237,685

(22) Filed: Jan. 27, 1999

(30) Foreign Application Priority Data

Jan. 25, 1998 (JP) ..... 10-015596

(51) Int. Cl.[7] ..... G09G 3/36
(52) U.S. Cl. ..... 345/98; 345/96
(58) Field of Search ..... 345/98, 99, 100, 345/87, 94, 96, 208, 209; 348/792

(56) References Cited

U.S. PATENT DOCUMENTS 5,057,928 10/1991 Nagashima ..... 338/236
5,526,014 6/1996 Shiba et al. ..... 345/87
5,748,169 * 5/1998 Okumura ..... 345/98
5,850,204 * 12/1998 Maekawa ..... 345/98
5,874,934 * 2/1999 Ito ..... 345/98
6,011,534 * 1/2000 Tanaka et al. ..... 345/98

FOREIGN PATENT DOCUMENTS 0 565 167 10/1993 (EP) .
0 747 748 12/1996 (EP) .
6-324645 11/1994 (JP) .

* cited by examiner

*Primary Examiner*—Dennis-Doon Chow
(74) *Attorney, Agent, or Firm*—Pillsbury Madison & Sutro LLP

(57) ABSTRACT

There is provided a display method of a flat display unit arranged so as to prevent an abnormality of a screen which is otherwise caused by coupling by inhibiting homo-polar video signals from being sampled within a sample and hold circuit having two circuits. Positive and negative polar video signals are sampled always alternately in A and B circuits of the respective sample and hold circuits of a signal line driving section by keeping the polarity of a video signal voltage before non-displaying timing same with that of the non-displaying timing, by stopping to switch the two systems of the sample and hold circuits and to output a signal when the non-displaying timing.

12 Claims, 7 Drawing Sheets

FLAT PANEL DISPLAY UNIT AND DISPLAY METHOD OF THE SAME

BACKGROUND OF THE INVENTION

1. Field of the Invention

The present invention relates to an active matrix type flat panel display unit and a display method thereof and more particularly to a flat panel display unit and a display method thereof whose driving method in non-displaying the predetermined video signal lines is improved.

2. Description of the Related Art

With the progress of the late highly advanced information society, the role of a display unit for displaying such information is increasing and a high definition, multi-gradation, down-sized, low power consumption and low cost display unit is now strongly desired. Under such circumstances, a variety of display units have been proposed and put into practical use. Among them, an active matrix type liquid crystal display is drawing attention as a display unit fulfilling such requirements.

One disclosed in JP-A-3-292088 may be cited as a conventional example using such active matrix type flat panel display unit as a display unit for displaying TV video signals. According to the technology described in JP-A-3-292088, a predetermined number of scanning line signals of a video signal are not used for displaying the image in accordance with a PAL system video signal having scanning signal lines whose number is larger than that of the display scan lines of the flat panel display unit for the NTSC system.

The structure of the active matrix type liquid crystal display panel will be explained below at first. As is well known, a plurality of signal lines, scan lines, TFTs (thin film transistors) as switching elements and pixel electrodes are arrayed in a matrix form on a surface of a first glass substrate, and color filters of red (R), green (G) and blue (B) for example for realizing color display, a counter electrode and others are formed on a surface of a second glass substrate in the liquid crystal display panel. It is then constructed by filling liquid crystal substance between the both glass substrates.

A signal line driving section (so-called a source driver) for controlling the signal lines of the liquid crystal display panel is a circuit for outputting pixel signal voltages corresponding to the respective signal lines and comprises a sampling pulse generating circuit, level shifters, sample and hold circuits using analog switches and sampling capacitors, an output circuit using an operational amplifier and a hold capacitor and others.

FIG. 7 is a timing chart showing a conventional driving method. Two sample and hold circuits (A and B) per each signal line outputs one of positive (+) and negative (−) polar pixel signal voltages (a, b, . . . ) to the signal line while sampling and holding them alternately from a video signal by switching the circuits A and B alternately per one horizontal scan period. It is noted that an inhibit signal INH in FIG. 7 is a control signal of the sample and hold circuit in the signal line driving section for controlling the switching of the two circuits (A and B) of the sample and hold circuit. A control signal OE is a signal for controlling such drive.

At first, the video signal inputted to the signal line driving section is sampled sequentially by a sampling clock corresponding to each signal line during each horizontal scan period. The start of the sampling within each horizontal scan period is controlled by a start pulse signal. The sampled signal (pixel signal voltage, abbreviated as "P.S.V." in the figure) is stored in the sample and hold circuit. At this time, one of two sample and hold circuits is selected. During the next horizontal scan period, the sample and hold circuit is switched to the other one (e.g., from A to B or B to A) by the inhibit signal INH. In the same time, the pixel signal voltage sampled during the previous horizontal scan period is outputted to the corresponding signal line.

For instance, pixel signal voltage (a) having + polarity is sampled and is stored in the A circuit of the sample and hold circuit during the first horizontal scan period. In the next horizontal scan period, the circuits (A and B) for sampling and holding a pixel signal voltage and the circuits (A and B) for outputting a pixel signal voltage which is stored therein are switched in accordance with the inhibit signal INH, the + polar pixel signal voltage a stored in the A circuit is outputted to the signal line and in the same time, pixel signal voltage (b) having − polarity is sampled and stored in the B circuit (see line 1).

In the next horizontal scan period, the circuits (A and B) are switched in accordance with the inhibit signal INH, the − polar pixel signal voltage (b) stored in the B circuit is outputted to the signal line and in the same time, pixel signal voltage (c) having + polarity is sampled and stored in the A circuit (see line 2). Similarly to that, in the next horizontal scan period, the circuits (A and B) are switched in accordance with the inhibit signal INH, the pixel signal voltage (c) having the + polarity and stored in the A circuit is outputted to the signal line and in the same time, pixel signal voltage (d) having + polarity is sampled and stored in the B circuit (see line 3). While a pixel signal voltage corresponding to the display scan line between the display scan lines 3 and 4 is not used for displaying in FIG. 7, the above-mentioned control is repeated sequentially when every pixel signal voltage should be used for displaying.

When the pixel signal voltage is outputted from the above-mentioned sample and hold circuit to the signal line so as to apply the voltage to the pixel electrode, a gate of a TFT connected to the pixel electrode must be turned on. It is implemented by a gate pulse outputted from a gate line driving section called a gate driver. The gate driver outputs the gate pulse sequentially to a corresponding scan line with inputted clock pulse. For instance, the TFT turns on at the leading edge of the gate pulse and turns off at the trailing edge thereof.

Next, the present situation of the drive technique in selective non-displaying of image signal will be explained. When a video signal of the PAL system is inputted to a display unit having a number of scanning line signals corresponding to the NTSC system, its image may be displayed in the PAL system across the whole screen by deleting pixel signal voltage corresponding to the predetermined display scan lines by the control signal OE during one horizontal scan period among six horizontal scan periods.

As for the pixel signal voltage and the counter electrode signal, the polarity of the pixel signal voltage not used in displaying images is kept same with that of the pixel signal voltage in the previous horizontal scan period so that the polarity is inverted per horizontal scan period contributing to the display. In the same time, the polarity of the counter electrode signal is not inverted within the horizontal scan period during which the pixel signal voltage is not used in displaying images.

That is, because the polarity of the video signal is not inverted and is kept same during the horizontal scan period prior to the horizontal scan period of the pixel signal voltage which is not used in displaying images, the + polar pixel signal voltage (d) is sampled and stored in the B circuit in the same time when the + polar pixel signal voltage (c) is outputted from the A circuit of the sample and hold circuit to the signal line for example. Then, the circuits (A and B) are switched and pixel signal voltage (e) having – polarity is sampled and stored in the A circuit during the next horizontal scan period during which the pixel signal voltage is not used for displaying. During the next horizontal scan period, the circuits (A and B) are switched and the pixel signal voltage (e) having the – polarity stored in the A circuit is outputted to the signal line and pixel signal voltage (f) having the + polarity is sampled and stored in the same time.

The problem of the conventional driving method described above lies in that the case when the pixel signal voltages having the same polarity are stored in the pair of circuits corresponding to the respective signal lines and the case when the pixel signal voltages having the different polarity are stored in the pair of circuits corresponding to the respective signal lines exist mixedly within a frame period. Due to that, coupling within the sample and hold circuits (among the circuits A and B) varies locally, thus causing an abnormality of the screen.

Accordingly, in view of the problem described above, it is an object of the present invention to provide a flat panel display unit, and a display method thereof, which is capable of displaying an image favorably even when scanning line signals not corresponding to a number of display scan lines are (for instance, the number of the scan line signals of the video signal is larger than that of the display scan lines of the display unit) inputted.

SUMMARY OF THE INVENTION

A flat panel display unit of the present invention comprises a display panel having a plurality of display scan lines, each including display pixels controlled by switching elements disposed in the vicinity of intersections of signal lines and scan lines; video outputting means for outputting a video signal to a video signal line, the polarity of which is inverted with respect to a reference voltage in correspondence to a horizontal scan period within each vertical scan period to a video signal line; at least a pair of sample and hold circuits corresponding to said signal line; sample and hold control means for alternately selecting a sampling and holding operation to one of said pair of sample and hold circuits and an outputting operation to the other one of said sample and hold circuits in each horizontal scan period, said sample and hold operation sampling a pixel signal voltage from the video signal at a predetermined timing, and said outputting operation outputting a sampled pixel signal voltage; and display control means for controlling said sample and hold control means so as to stop the alternately selecting in accordance with non-displaying timing in the vertical scan period of the video signal and for controlling said video outputting means so as to stop to invert the polarity of said video signal in accordance with said non-displaying timing in the vertical scan period of the video signal, thereby, the polarity of the pixel signal voltage stored at least in said pair of sample and hold circuits being kept same within one vertical scan period.

Further, according to a display method of a present inventive flat panel display unit comprising a display panel having a plurality of display scan lines, each including display pixels controlled by switching elements disposed in the vicinity of intersections of signal lines and scan lines; video outputting means for outputting a video signal to a video signal line, the polarity of which is inverted with respect to a reference voltage in correspondence to a horizontal scan period within each vertical scan period to a video signal line; at least a pair of sample and hold circuits corresponding to said signal line; sample and hold control means for alternately selecting a sampling and holding operation to one of said pair of sample and hold circuits and an outputting operation to the other one of said sample and hold circuits in each horizontal scan period, said sample and hold operation sampling a pixel signal voltage from the video signal at a predetermined timing, and said outputting operation outputting a sampled pixel signal voltage; said display method comprising steps of controlling said sample and hold control means so as to stop the alternately selecting in accordance with non-displaying timing in the vertical scan period of the video signal and for controlling said video outputting means so as to stop to invert the polarity of said video signal in accordance with said non-displaying timing in the vertical scan period of the video signal, thereby, the polarity of the pixel signal voltage stored at least in said pair of sample and hold circuits being kept same within one vertical scan period.

According to the invention, positive and negative polar video signals are sampled always alternately in the respective sample and hold circuits by keeping the polarity of a video signal voltage before non-displaying timing same with that of the non-displaying timing, by stopping to switch the two systems of the sample and hold circuits and to output a signal when the non-displaying timing. Accordingly, the homo-polar video signals will not be sampled within the two circuits of the sample and hold circuits and the abnormality of the screen which is otherwise caused by coupling may be prevented.

The specific nature of the invention, as well as other objects, uses and advantages thereof, will clearly appear from the following description and from the accompanying drawings in which like numerals refer to like parts.

DESCRIPTION OF THE PREFERRED EMBODIMENT

A liquid crystal display 100 of one embodiment of the present invention and a display method thereof will be explained below in detail with reference to FIGS. 1 through 6.

At first, the overall structure of the liquid crystal display 100 of the present embodiment will be explained. The liquid crystal display 100 has about 250 display scan lines in correspondence to the NTSC system. And the liquid crystal display 100 is capable of displaying an image even when a number of scanning line signals is greater than the number of display scan lines like the PAL system by not using in display with a predetermined number of scan line signals of video signals.

Figure 1:
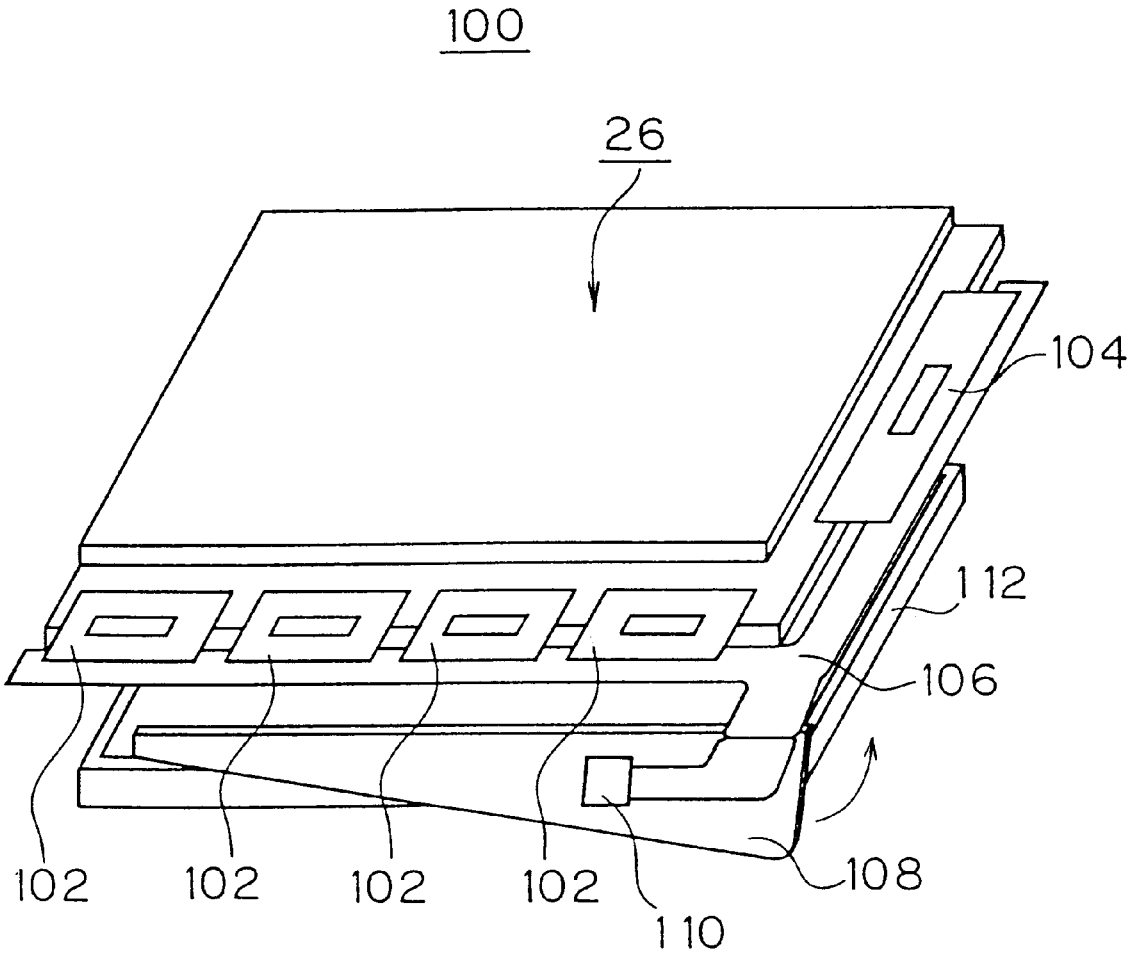
FIG. 1 is a perspective view of a liquid crystal display.

As shown in FIG. 1, a plurality of X-TCPs (tape carrier package) 102 are disposed on one edge of a liquid crystal display panel 26 and a Y-TCP 104 Is disposed on the other edge in the liquid crystal display 100. The XTCPs 102 and the Y-TCP 104 are connected to a flexible printed circuit film (FPC) 106 to which a printed circuit board (PCB) 108 is connected. A control IC 110 is provided on the PCB 108. A back light device 112 is disposed on the back surface of the liquid crystal display panel 26.

A signal line driving section 24 is contained in the X-TCP 102, a gate line driving section 22 is contained in the Y-TCP 104, and a synchronizing signal processing section 20, a demodulating section 12, a bi-polarity outputting section 14, a polarity processing section 16 and an RGB signal combining section 18 are contained in the control IC 110 as described later.

Figure 3:
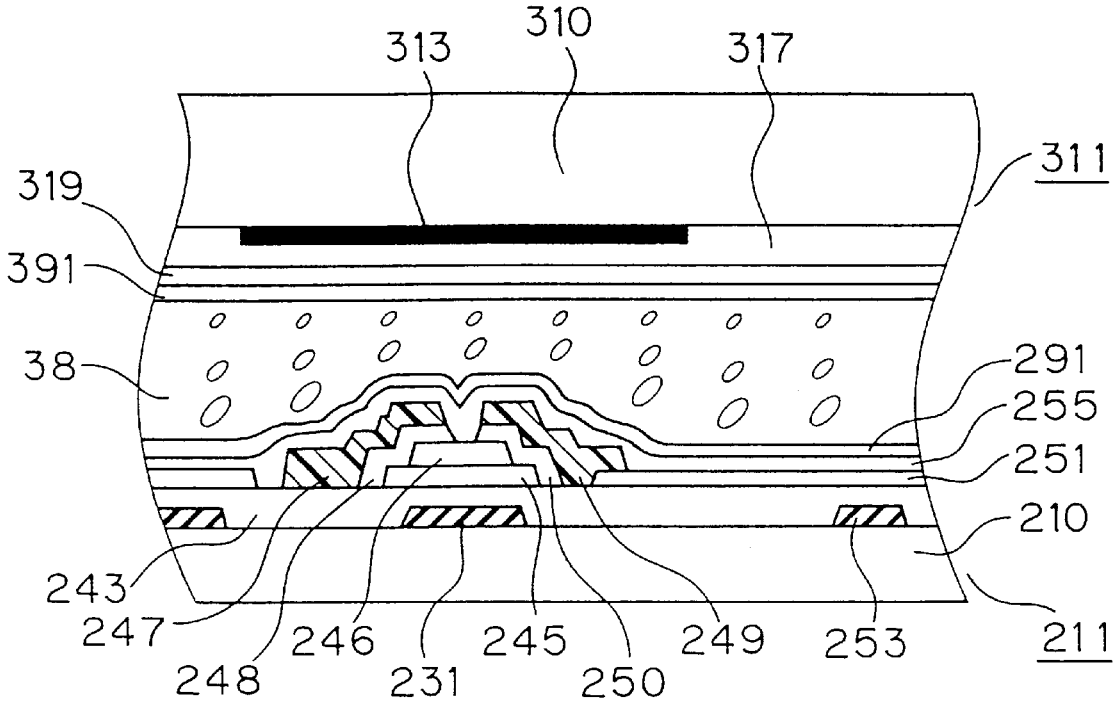
FIG. 3 is a part of cross sectional view of the liquid crystal display panel.

As shown in FIG. 3, a liquid crystal layer 38 composed of twisted nematic liquid crystal presenting positive dielectric anisotropy is stored between an array substrate 211 and a counter substrate 311 via orientation films 291 and 391.

Figure 2:
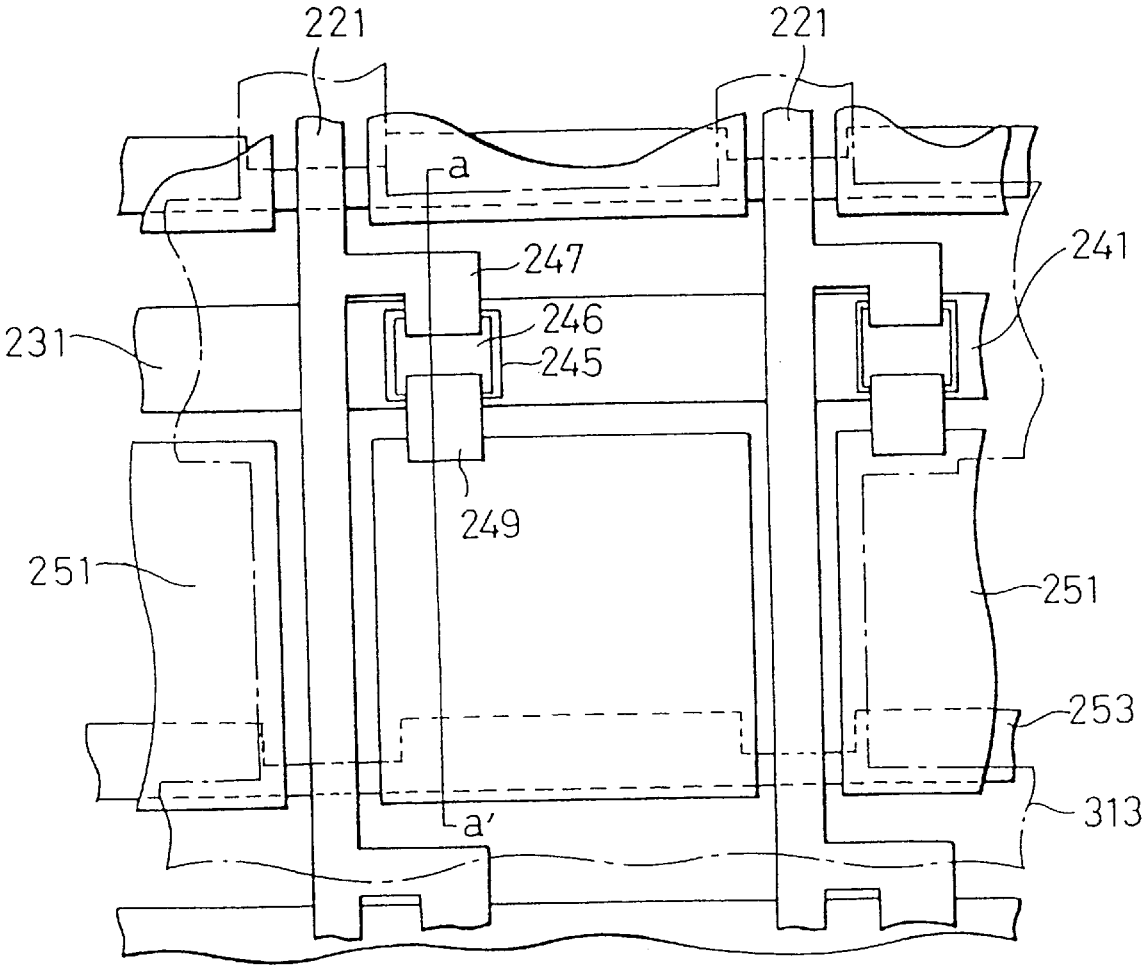
FIG. 2 is a part of plan view of an array substrate of the liquid crystal display panel.

In the array substrate 211, signal lines 221 and scan lines 231 are disposed so as to approximately intersect each other on a transparent glass substrate 210 of 0.7 mm thick as shown in FIG. 2, and a thin film transistor (hereinafter abbreviated to as a TFT) 241 is disposed in the vicinity of each intersections of the signal lines 221 and the scan lines 231. As shown in FIG. 3, the TFT 241 comprises the scan line 231 itself as a gate electrode, an amorphous silicon thin film 245 disposed above the scan line 231 via a gate insulating film 243, a semiconductor protection film 246 made of silicon nitride (SiNx) and self-aligned with the scan line 231 to protect the amorphous silicon thin film 245 and to suppress parasitic capacitance, a drain electrode 247 extended from the signal line 221 for electrically connecting the amorphous silicon thin film 245 with the signal line 221 via an $n^+$ type amorphous silicon thin film 248 and a source electrode 249 for electrically connecting a pixel electrode 251 made of ITO (indium tin oxide) disposed in an area surrounded by the signal line 221 and the scan line 231 with the amorphous silicon thin film 245 via an $n^+$ amorphous silicon thin film 250. Thus, the TFT 241 has an inverted staggered structure. An auxiliary capacitor lines 253 for forming auxiliary capacitors (Cs) among the pixel electrodes 251 via the gate insulating film 243 are also disposed approximately in parallel with the scan lines 231. Still more, a protection film 255 is disposed on the TFT 241 and the pixel electrode 251. Thus, the array substrate 211 is constructed.

The counter substrate 311 comprises, on a transparent glass substrate 310 of 0.7 mm thick, a light shielding layer 313 made of chrome (Cr) in a matrix for shielding the light toward the TFTs 241 and the peripheral portion of the pixel electrodes 251 on the array substrate 211, a color filter layer 317 disposed on the light shielding layer 313 and a counter electrode 319 made of ITO and disposed on the color filter layer 317.

Figure 4:
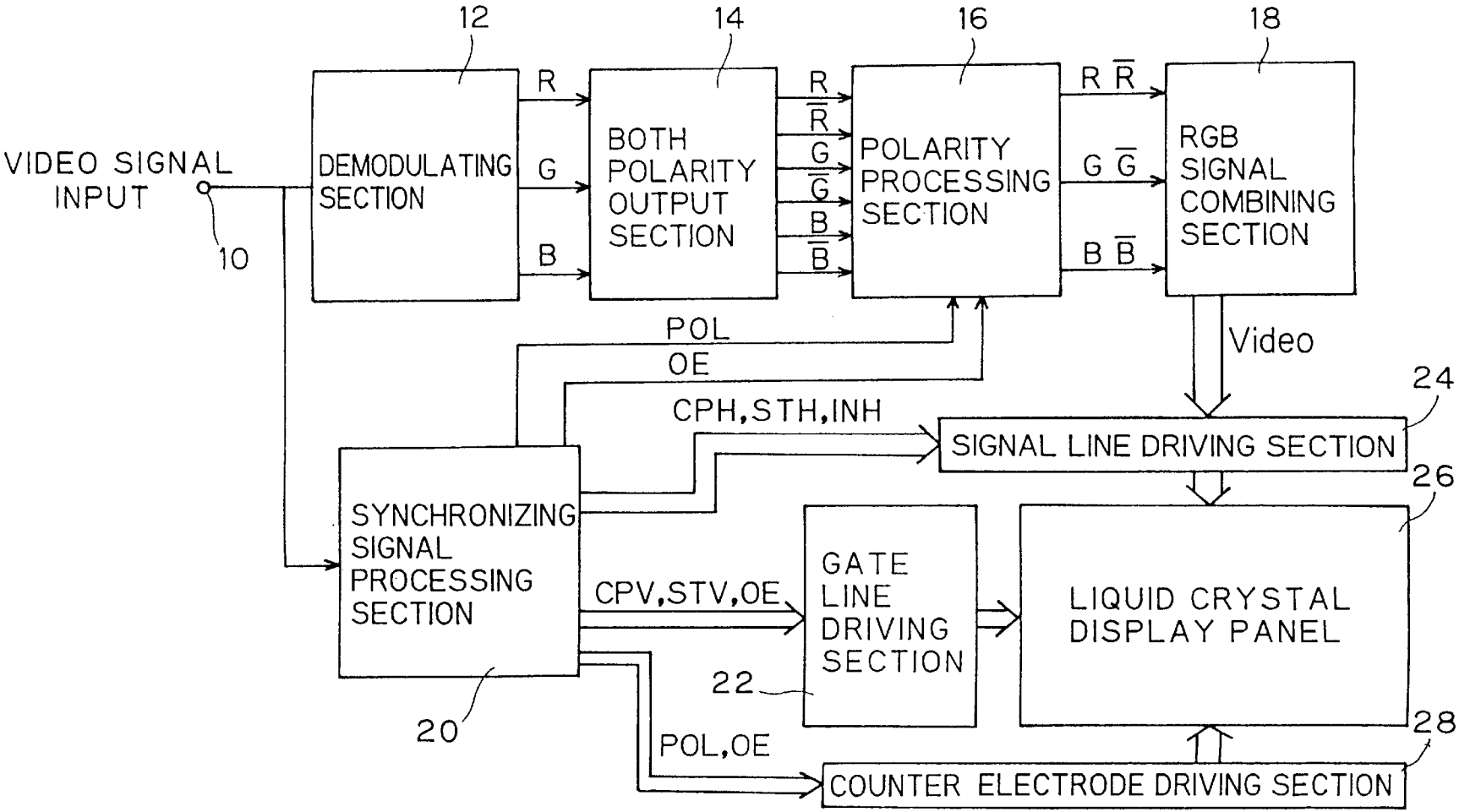
FIG. 4 is a schematic block diagram of the liquid crystal display.

As shown in FIG. 4, the synchronizing signal processing section 20 takes out a horizontal synchronizing signal Hsync and a vertical synchronizing signal Vsync and in accordance with those synchronizing signals H/Vsync, generates a horizontal start pulse STH, a vertical start pulse STV, a horizontal clock signal CPH, a vertical clock signal CPV, an inhibit signal INH, OE control signal OE and a polarity inversion signal POL necessary for driving the liquid crystal display panel 26.

The polarity inversion signal POL is synchronized with each horizontal scan period and each vertical scan period. The control signal is a control signal which keeps low level when a video signal of the NTSC system is inputted and which turns to high level per each predetermined horizontal scan period when there are a greater number of scanning line signals such as the PAL system which does not conform to the number of display scan lines. It keeps the high level for one horizontal scan period among six horizontal scan periods when the video signal of the PAL system is inputted in the present embodiment.

The control signal OE and the polarity inversion signal POL are outputted to the polarity processing section 16 and the counter electrode driving section 28, respectively. Further, the horizontal start pulse STH, the horizontal clock signal CPH and the inhibit signal INH are outputted to the signal line driving section 24 and the vertical start pulse STV, the vertical clock signal CPV and the control signal OE are outputted to the gate line driving section 22, respectively.

Then, the analog video signal of the NTSC system or the PAL system, for example, inputted from an input terminal 10 is demodulated and adjusted to three primary color signals of red (R), green (G) and blue (B) by the demodulating section 12. The bi-polarity outputting section 14 also generates negative polar three primary color signals by inverting the positive polar three primary color signals with respect to a reference voltage, for instance 0 V, and outputs the positive and negative polar three primary color signals. The polarity processing section 16 mixes the positive and negative polar three primary color signals from the bi-polarity outputting section 14 and outputs three primary color signals in accordance with the polarity inversion signal POL from the synchronizing signal processing section 20. And The polarity processing section 16 outputs three primary color signals whose polarity has been inverted with respect to the reference voltage and which is outputted per each horizontal scan period between the frames so that DC voltage is not applied continuously to a liquid crystal layer 38 (see FIG. 6) of the active matrix liquid crystal display panel 26 and so that flicker or the like is fully reduced. Then, the RGB combining section 18 combines the three primary color signals outputted from the polarity processing section 16 in correspondence to the array of the color filters of the liquid crystal display panel 26 and outputs them as the video signal Video.

The counter electrode driving section 28 outputs a counter electrode signal Vcom whose polarity is inverted with reference to the reference voltage, for instance 0 V, per each horizontal scan period within each frame in accordance with the polarity inversion signal POL sent from the synchronizing signal processing section 20. The counter electrode signal Vcom is synchronized with the polarity inversion timing of the above-mentioned video signal Video and is adjusted so that its phase differs by 180° from that of a pixel signal voltage Vsig outputted to the signal line D described later to lower the withstand voltage of the signal line driving section 24. Thus, the common inversion drive may be achieved. The counter electrode driving section 28 is also inhibited from inverting the polarity during the period when the polarity inversion signal POL is masked by the control signal OE described later sent from the synchronizing signal processing section 20 and when the control signal OE is on the high level.

Figure 6:
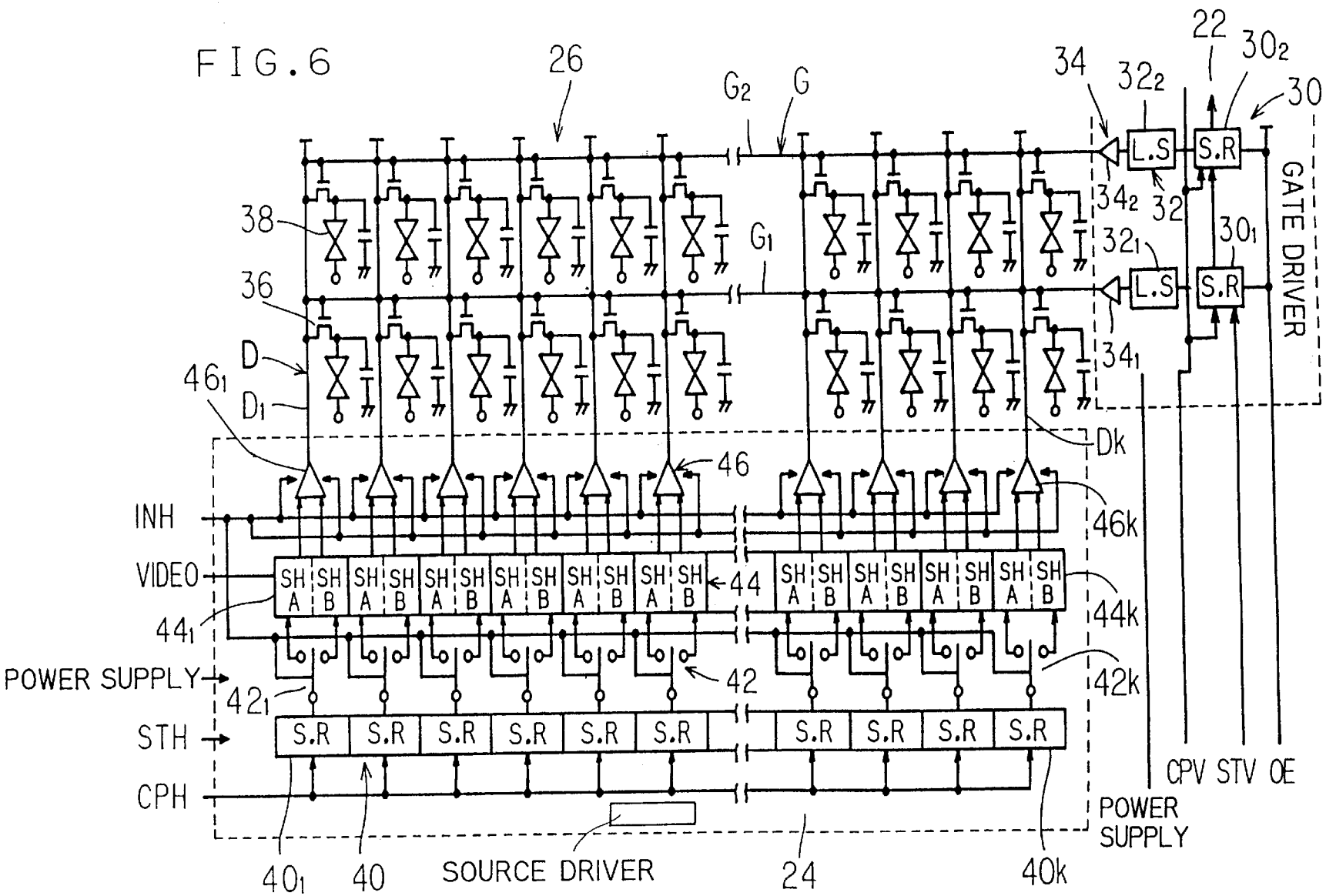
FIG. 6 is a block diagram of a signal line driving section and others.
Figure 7:
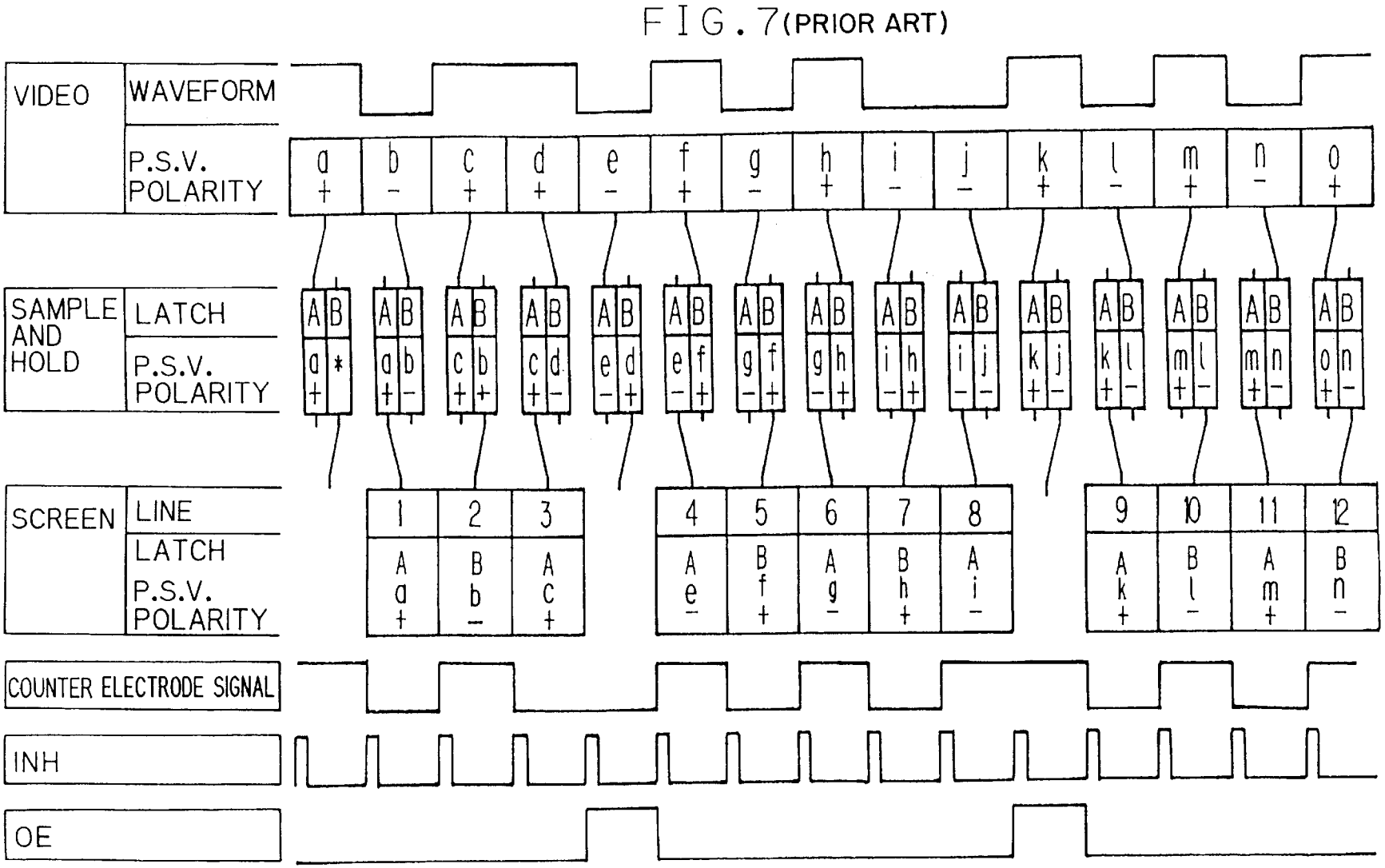
FIG. 7 (PRIOR ART)
FIG. 7 is a timing chart showing control operations of a conventional example.

FIG. 6 is a block diagram showing the liquid crystal display panel 26, the gate line driving section 22, the signal line driving section 24 and others. The structure of each section will be explained below. The liquid crystal display panel 26 comprises the pixel electrodes (not shown) arrayed two-dimensionally on the glass substrate not shown, scan lines G (G1, . . . ) disposed respectively between the pixel electrodes and signal lines D (D1 through Dk) intersecting with the scan lines G (G1, . . . ).

Each signal line D is connected with the signal line driving section 24 and each scan line G is connected with the gate line driving section 22. The TFT 36 is interposed between the pixel electrode and the signal line D and the scan line G. Then, the scan line G is connected with a gate of the TFT 36, the signal line D is connected with a drain electrode of the TFT 36, and the pixel electrode is connected with a source electrode of the TFT 36, respectively. The reference numeral 38 denotes the liquid crystal whose one end is connected with the pixel electrode connected with the drain of the TFT 36 and the other end is connected with the counter electrode connected with the counter electrode driving section 28.

In order to output the gate pulse Vg sequentially corresponding to the scan lines G (G1, . . . ) of the liquid crystal display panel 26, the gate line driving section 22 comprises shift registers 30 (301, 302, . . . ) for sequentially transferring and outputting the vertical start signal STV in accordance with the vertical clock signal CPV and level shift circuits 32 (321, 322, . . . ) for setting the output of the shift registers 30 (301, 302, . . . ) at the gate pulse Vg having a predetermined amplitude. The transfer operation of the shift registers 30 (301, 302, . . . ) is inhibited during the period when the control signal OE is on the high level.

The signal line driving section 24 comprises shift registers (401 through 40*k*) for outputting sampling signals sequentially in accordance with the horizontal clock signal CPH and the horizontal start signal STH for controlling the start of the operation to sequentially sample the pixel signal voltage Vsig corresponding to each signal line D (D1 through Dk) within each horizontal scan period from the video signal Video, sample and hold circuits 44 (441 through 44*k*) comprising a pair of two circuits (A and B) provided in correspondence to the output of each shift register 40 (401 through 40*k*), switching sections 42 (421 through 42*k*) for selectively outputting the pixel signal voltage sampled from the video signal Video in accordance with the output of each shift register to either one of the pair of two circuits (A and B) in accordance with the inhibit signal INH, transfer gates 46 (461 through 46*k*) for selectively obtaining the output from either one of the pair of two circuits (A and B) in accordance with the inhibit signal INH, and others. More specifically, the inhibit signal INH controls the switching such that either one of the two circuits (A and B) to which the pixel signal voltage is sampled and stored differs from either one of the two circuits (A and B) from which the pixel signal voltage is outputted and controls the output of the sampled and stored pixel signal voltage.

By constructing as described above, according to the present embodiment, the control signal OE which keeps the high level is outputted during one horizontal scan period among six horizontal scan periods in this embodiment when the video signal of the PAL system is inputted. Thereby, the operation of the shift registers 30 (301, 302, . . . ) of the gate line driving section 22 is stopped and the output of the gate pulse Vg to the scan lines G (G1, . . . ) is inhibited during one horizontal scan period among the six horizontal scan periods.

The control signal OE is also outputted while masking the above-mentioned inhibit signal INH within the synchronizing signal processing section 20 and the switching and reading operations of the sample and hold circuit 44 is inhibited during the horizontal scan period in which the control signal OE is on the high level.

In the same time, the inversion of the polarity of the counter electrode signal Vcom is also inhibited during the horizontal scan period in which the control signal OE is on the high level and the polarity is kept same with that in the horizontal scan period just before. Further, because the sample and hold circuit 44 (441 through 44k) comprises the pair of two circuits (A and B) which are selected alternately per each horizontal scan period in the present embodiment, the inversion of the polarity of the video signal Video is inhibited during the horizontal scan period in which the control signal OE is on the high level and the same polarity is kept with that in the previous horizontal scan period.

Figure 5:
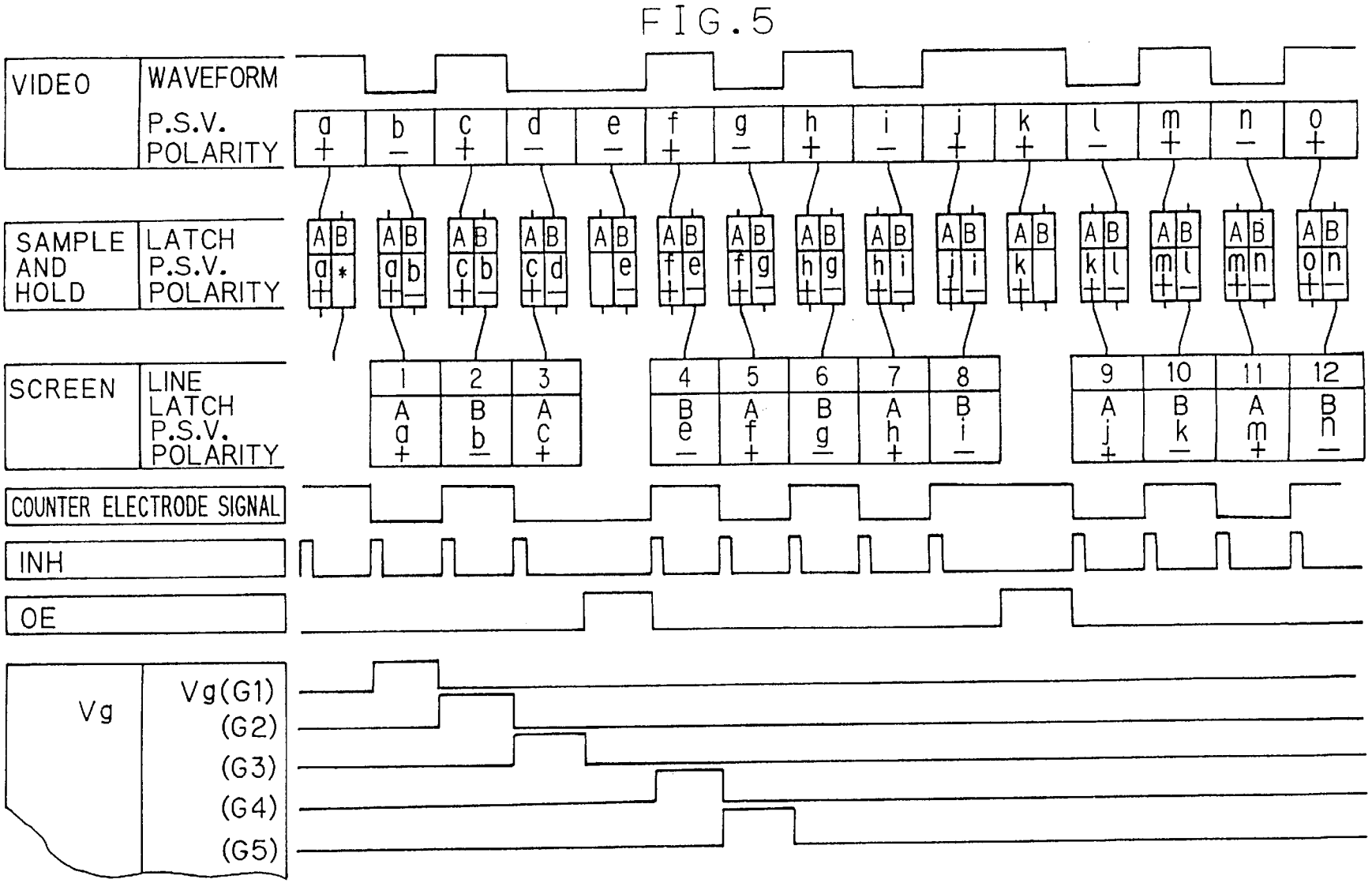
FIG. 5 is a timing chart showing control operations according to a preferred embodiment of the present invention.

FIG. 5 is a timing chart for explaining the operation of the above-mentioned liquid crystal display and shows the display control in displaying the video signal of the PAL system instead of the video signal of the NTSC system. It is noted that parts in FIG. 6 indicated by broken lines are parts whose timing are changed.

By constructing the unit as described above, the present embodiment prevents the abnormality of the screen by suppressing the polarity of the signals within the pair of two circuits (A and B) composing the sample and hold circuit from becoming the same during each frame period by inverting the polarity of the pixel signal voltage not used in displaying images and by keeping the same polarity by inhibiting the inversion of the polarity of the later one and by controlling so that no considerable variation occurs in the coupling of the respective pair of two circuits (A and B).

While the video signal Video whose polarity is inverted per each horizontal scan period is inputted, it is processed as the video signal Video whose polarity is not inverted during the horizontal scan period after the horizontal scan period during which the video signal Video is not used in display with the rate of one horizontal scan period per six horizontal scan periods.

At first, + polar pixel signal voltage (a) is sampled and stored in the A circuit of the sample and hold circuit 44 during the first horizontal scan period.

In the next horizontal scan period, the circuit (A and B) for sampling and holding the pixel signal voltage in accordance with the inhibit signal INH and the circuit (A and B) for outputting the sampled and stored pixel signal voltage are switched, the + polar pixel signal voltage (a) stored in the A circuit is outputted to the signal line D and in the same time, − polar pixel signal voltage (b) is sampled and stored in the B circuit. Further, the gate pulse Vg (G1) is outputted to the scan line G1 and the pixel signal voltage (a) is applied to the pixel electrode corresponding to the scan line G1. Thereby, a display is made on the display scan line 1 in accordance with the potential difference between the pixel signal voltage a and the counter electrode signal Vcom.

In the next horizontal scan period, the circuits (A and B) are switched in accordance with the inhibit signal INH, the − polar pixel signal voltage (b) stored in the B circuit is outputted to the signal line D and in the same time, + polar pixel signal voltage (c) is sampled and stored in the A circuit. Further, the gate pulse Vg (G2) is outputted to the scan line G2 and the pixel signal voltage (b) is applied to the pixel electrode corresponding to the scan line G2. Thereby, a display is made on the display scan line 2 in accordance with the potential difference between the pixel signal voltage (b) and the counter electrode signal Vcom. Similarly, in the next horizontal scan period, the circuits (A and B) are switched in accordance with the inhibit signal INH, the + polar pixel signal voltage (c) stored in the B circuit is outputted to the signal line D and in the same time, − polar pixel signal voltage (d) is sampled and stored in the A circuit. Further, the gate pulse Vg (G3) is outputted to the scan line G3 and the pixel signal voltage (c) is applied to the pixel electrode corresponding to the scan line G3. Thereby, a display is made on the display scan line 3 in accordance with the potential difference between the pixel signal voltage (c) and the counter electrode signal Vcom.

In the next horizontal scan period, because the control signal OE turns to the high level and the inhibit signal INH is masked, the circuits (A and B) are not switched and no output operation is made. Because the inversion of the polarity of the video signal and the counter electrode signal Vcom is inhibited, − polar pixel signal voltage (e) is overwritten to the B circuit and outputting to the signal line D is inhibited. In the same time, the control signal OE inhibits the gate pulse from being outputted to the display scan line 4. Thereby, pixel signal voltage is not used in displaying images for one horizontal scan period.

In the next horizontal scan period, the control signal OE is set on the low level, so that the switches (A and B) are switched in accordance with the inhibit signal INH, the − polar pixel signal voltage (e) stored in the B circuit is outputted to the signal line D and in the same time, + polar pixel signal voltage (f) is sampled and stored in the A circuit. Further, the gate pulse Vg (G4) is outputted to the scan line G4 and the pixel signal voltage (e) is applied to the pixel electrode corresponding to the scan line G4. Thereby, a display is made on the display scan line 4 in accordance with the potential difference between the pixel signal voltage e and the counter electrode signal Vcom.

Thus, the + polar pixel signal voltage is always stored in the A circuit of the sample and hold circuit 44 and the − polar pixel signal voltage whose polarity has been inverted is stored in the B circuit during this frame period. Thereby, no considerable difference occurs in the coupling of the two circuits (A and B) within the frame period. Similarly to that, the − polar pixel signal voltage is always stored in the A circuit of the sample and hold circuit 44 (not shown) and the + polar pixel signal voltage whose polarity has been inverted is stored in the B circuit in the next frame period. Thereby, no considerable difference occurs in the coupling of the two circuits (A and B) within the frame period. Therefore, the liquid crystal display of the present embodiment assures the good display quality even when the selective non-displaying or culling operation is implemented.

Although the case when the sample and hold circuit 44 has the two circuits (A and B) has been explained in the embodiment described above, the sample and hold circuit 44 may have three or more circuits. Further, although the polarity of the counter electrode signal has been inverted in synchronism with the inversion of the polarity of the pixel signal voltage, it may be a DC voltage.

As described above, according to the invention, because the pair of sample and hold circuits connected at least with one signal line is selectively controlled and the polarity of the pixel signal voltage stored in the pair of sample and hold circuits is the same across each frame period, it is possible to prevent the abnormality of the screen caused by the coupling of the sample and hold circuits.

While the preferred embodiment has been described, variations thereto will occur to those skilled in the art within the scope of the present inventive concepts which are delineated by the following claims.

What is claimed is:

1. A flat panel display unit, comprising:

a display panel having a plurality of display scan lines, each including display pixels controlled by switching elements disposed in the vicinity of intersections of signal lines and scan lines;

video outputting means for outputting a video signal to a video signal line, the polarity of which is inverted with respect to a reference voltage in correspondence to a horizontal scan period within each vertical scan period to a video signal line;

at least a pair of sample and hold circuits corresponding to said signal line;

sample and hold control means for alternately selecting a sampling and holding operation to one of said pair of sample and hold circuits and an outputting operation to the other one of said sample and hold circuits in each horizontal scan period, said sample and hold operation sampling a pixel signal voltage from the video signal at a predetermined timing, and said outputting operation outputting a sampled pixel signal voltage; and display control means for controlling said sample and hold control means so as to stop the alternately selecting in accordance with non-displaying timing in the vertical scan period of the video signal and for controlling said video outputting means so as to stop to invert the polarity of said video signal in accordance with said non-displaying timing in the vertical scan period of the video signal, thereby, the polarity of the pixel signal voltage stored at least in said pair of sample and hold circuits being kept same within one vertical scan period.

2. The flat panel display unit according to claim 1, wherein the polarity of said video signal is inverted per each horizontal scan period.

3. The flat panel display unit according to claim 1, further comprising scan line driving means connected to said scan lines for sequentially outputting scan pulses, wherein scan pulse are selectively inhibited in accordance with said non-displaying timing.

4. The flat panel display unit according to claim 1, wherein said display pixels comprise pixel electrodes electrically connected to said switching elements, a counter electrode opposing to the pixel electrodes, and counter electrode driving means for supplying a counter electrode signal to said counter electrode.

5. The flat panel display unit according to claim 4, wherein said counter electrode driving means outputs said counter electrode signal whose polarity is inverted with respect to a reference voltage in synchronism with the inversion of the polarity of said video outputting means.

6. The flat panel display unit according to claim 5, wherein said display control means controls so as to stop the inversion of the polarity of said counter electrode signal in accordance with the non-displaying timing.

7. A display method of a flat panel display unit, comprising:

a display panel having a plurality of display scan lines, each including display pixels controlled by switching elements disposed in the vicinity of intersections of signal lines and scan lines;

video outputting means for outputting a video signal to a video signal line, the polarity of which is inverted with respect to a reference voltage in correspondence to a horizontal scan period within each vertical scan period to a video signal line;

at least a pair of sample and hold circuits corresponding to said signal line;

sample and hold control means for alternately selecting a sampling and holding operation to one of said pair of sample and hold circuits and an outputting operation to the other one of said sample and hold circuits in each horizontal scan period, said sample and hold operation sampling a pixel signal voltage from the video signal at a predetermined timing, and said outputting operation outputting a sampled pixel signal voltage;

said display method comprising steps of:

controlling said sample and hold control means so as to stop the alternately selecting in accordance with non-displaying timing in the vertical scan period of the video signal and for controlling said video outputting means so as to stop to invert the polarity of said video signal in accordance with said non-displaying timing in the vertical scan period of the video signal, thereby, the polarity of the pixel signal voltage stored at least in said pair of sample and hold circuits being kept same within one vertical scan period.

8. The display method according to claim 7, wherein the polarity of said video signal is inverted per each horizontal scan period.

9. The display method according to claim 7, further comprising scan line driving means connected to said signal lines for sequentially outputting scan pulses and wherein the output of said scan pulse is inhibited in accordance with the non-displaying timing of said display control means.

10. The display method according to claim 7, wherein said display pixel comprises a pixel electrode connected via said switching element and a counter electrode opposing to the pixel electrode and counter electrode driving means for supplying a counter electrode signal to said counter electrode.

11. The display method of the flat display unit according to claim 10, wherein said counter electrode driving means outputs said counter electrode signal whose polarity is inverted with respect to the reference voltage in synchronism with the inversion of the polarity of said video outputting means.

12. The display method according to claim 11, wherein said display control means controls so as to stop the inversion of the polarity of said counter electrode signal in accordance with said non-displaying timing.

* * * * *